US005238320A

United States Patent [19]

Komatsu et al.

[11] Patent Number: 5,238,320

[45] Date of Patent: Aug. 24, 1993

[54] PEN NIB OF A WRITING INSTRUMENT

[75] Inventors: Takahiro Komatsu; Tetsuo Shimoishi, both of Hamamatsu, Japan

[73] Assignee: Teibow Company Limited, Sizuoka, Japan

[21] Appl. No.: 898,957

[22] Filed: Jun. 15, 1992

[30] Foreign Application Priority Data

| | | | |
|---|---|---|---|
| Jun. 14, 1991 | [JP] | Japan | 3-44996[U] |
| Mar. 30, 1992 | [JP] | Japan | 4-17744[U] |
| Apr. 28, 1992 | [JP] | Japan | 4-28502[U] |

[51] Int. Cl.[5] ..... B43K 1/00; B43K 8/02

[52] U.S. Cl. ..... 401/265; 401/199; 401/292; 346/140 A

[58] Field of Search ..... 401/292, 265, 199, 196, 401/198; 346/140 A

[56] References Cited

U.S. PATENT DOCUMENTS

| | | | |
|---|---|---|---|
| 2,431,015 | 11/1947 | Andrews et al. | 401/265 X |
| 3,467,478 | 9/1969 | Webber | 401/292 |
| 3,614,248 | 10/1971 | Otsuka . | |
| 3,778,495 | 12/1973 | Woolley | 401/265 X |
| 3,933,965 | 1/1976 | Gallone et al. . | |
| 4,215,948 | 8/1980 | Hori et al. . | |
| 4,551,038 | 11/1985 | Baker et al. | 401/265 |

FOREIGN PATENT DOCUMENTS

| | | | |
|---|---|---|---|
| 2535906 | 2/1977 | Fed. Rep. of Germany | 401/196 |
| 2228599 | 3/1974 | France . | |
| 2386421 | 4/1978 | France . | |
| 1112684 | 5/1968 | United Kingdom | 401/198 |
| 2169562 | 7/1986 | United Kingdom . | |
| 2217658 | 11/1989 | United Kingdom . | |

*Primary Examiner*—Steven A. Bratlie

*Attorney, Agent, or Firm*—Burgess, Ryan & Wayne

[57] ABSTRACT

A pen nib preferably for use in a high speed writing, having a coaxial capillary passage for ink. The coaxial passage extends axially in the nib body, and has, in a cross-sectional view, a coaxial portion, a plurality of outer portions and intermediate connecting portions between the coaxial portion and respective outer portions. The coaxial passage partially opens axially at peripheral openings formed in a round or sharped head of the nib, that is the coaxial portion and intermediate portions are all closed axially at the head, and the outer portions are open axially at the peripheral openings formed such that they are arranged at a top surface of the head around the center thereof. The intermediate passage portions may be open radially at the peripheral openings. The nib is made of hard and wear material such as metal, ceramic or thermosetting resin by an injection molding with a subsequent heat treatment. Each peripheral opening is chamfered to give a round edge, and preferably are formed to have a groove following the round edge for guiding and discharging dust from the utmost radially outer edge thereof.

14 Claims, 16 Drawing Sheets

PEN NIB OF A WRITING INSTRUMENT

BACKGROUND OF THE INVENTION

1. Field of the Invention

The present invention relates to an improved pen nib of a writing instrument, particularly a pen nib made of a hard material such as hard plastics, metals or ceramics.

2. Description of the Related Art

Plastic pen nibs are well known and many patents have been granted for such plastic pen nibs. Most pen nibs are produced by an extruding method using a perforated die or a binding method whereby preproduced plastic filaments are bound to form capillary passages. Both of these methods produce a pen nib having plurality of ink capillary passages formed therein, and all of such passages are axial hollow extensions open axially at the head of a longitudinal plastic pen nib. The head is worked to have a round or shaped profile in a subsegment process, as desired.

JP-B 49-2132 (Japanese Examined Patent publication), for example, shows dies for use in such an extruding method, and various patterns of axially extending capillary ink passages with openings formed at the nib head. Each opening has the same profile or pattern as that of the axially extending passage, when the nib is seen in the axial direction, i.e., in an axially front view of the longitudinal nib.

U.S. Pat. No. 3,558,392 and EP 82,206 disclose the binding methods with plastic filaments of producing pen nibs, each having axially extending capillary ink passages with openings formed at the nib heads. Each passage of a nib has the same profile as that of its outlet or opening in a front view of the nib, as in the above JP reference.

Recently, there is an increased demand for pen nibs for high speed writing instruments used in plotters automatically indicating detection outputs or in drawing apparatuses.

Such a high speed writing pen nib must, of course, have a wear resistance against paper as the pen nib is in intermittently contact with and slides over the paper surface at a high speed.

In this regard, JP-A-60-112497 discloses a wear pen nib of metal for use in a dot type printer or various recording devices, which are kinds of plotters. Powder metal with a water solvable salt such as sodium chloride is pressed in a mold to form a nib blank, and the metal blank is sintered with the result that the sintered nib has randomly arranged perforations formed in the entire body, which, in combination, form many capillary passages therein. This nib is similar to a conventional pen nib of a felt block. The above sintered metal nib and the conventional felt nib do not have axially straight ink passages formed artificially, but have only naturally formed ink passages in the form of random perforations or the like.

JP-A 1-146797 also describes inorganic wear pen nibs of metals or ceramics. Powder of the wear material is press-formed in a mold and sintered to form a nib having a plurality of molded ink passages, each extending axially and completely opening axially or straight forwardly opening at the nib head.

Therefore, the disclosed inorganic pen nibs are common to those of the above mentioned conventional extruded or bound plastic pen nibs in that each axially extending capillary ink passage has the same profile as that of its opening or outlet formed at the nib head, in an axially front view of the nib, with the same size.

With respect to the high speed writing with the wear pen nib, the inventors recognized that the conventional wear pen nib is apt to scratch the paper, with the result that the surface of the paper is damaged, and that dust produced from the paper is apt to enter the passage openings at the nib head and clog them. As a result, there is a tendency for the wear nib pen to be unable to continue a smooth and good writing performance. That is, with the wear nib pen, the dust prevents the ink from flowing out smoothly from the openings, even if it does not clog them all, with the result that lines, letters or the like written by the ink on the paper become blurred, i.e., the pen becomes scratchy. Further, the writing resistance is increased relative to the conventional plastic pen nib due to the hard edges of the passage openings. The conventional plastic pen nib is plastically deformable, and thus its passage openings have soft edges in comparison with those of the wear nib.

A hard resin pen nib made of a thermosetting resin molded to have capillary ink passages and openings, with profiles similar to the conventional ones, exhibits substantially the same poor writing performance, when used for a high speed writing, as that of the inorganic pen nib, even though the hard resin pen nib may have a lower wear property than the inorganic nib.

It is noted that a pen nib having no coaxial opening, such as those shown in FIG. 2 of JP-A 146797 and in FIG. 6 of JP-B 49-2132 mentioned above, exhibits less writing resistance than the other nibs having a coaxial passage opening, i.e., a central outlet formed in the head at a central area of the head surface. This is because the edge of the coaxial opening is apt to scratch a paper during writing, but the central surface area having no opening exhibits no substantial resistance to the paper, so long as the head forms a smooth round central surface.

In a low speed writing, such a scratching tendency does not cause a paper to be damaged and to produce dust to a substantial extent in practice, and such a coaxial opening is advantageous in ensuring a smooth and continuous ink supply onto the paper. This is because no coaxial opening causes the area effective for allotting a desired pattern of peripheral passage openings to be reduced and limited in scope in the entire top head surface.

Even with the same entire opening area (i.e., areas of plural openings) between the non coaxial opening case and the coaxial opening case, the coaxial opening case is able to write a line having a narrowed width with a better ink flow, although the performance is definitely influenced by a capillary action of the ink passages formed in the nib body.

Further, in comparison with a conventional coaxial opening case having a coaxial opening and peripheral openings, a conventional non-coaxial opening case having only peripheral openings equivalent to those of the coaxial opening case is, as a matter of course, inferior to the coaxial opening case in respect of the ink supply ability thereof.

SUMMARY OF THE INVENTION

An object of the present invention is to provide an improved pen nib advantageously applicable for a high speed writing with a plotter or the like, although such a pen is also applicable for a normal or low speed writing.

The present invention is based on the concept that such a non-coaxial opening case as above is provided with an internal longitudinal ink reservoir formed in a longitudinal nib, and while the ink is supplied onto a paper during writing directly through peripheral ink passage openings at the nib head from an external ink tank or reservoir provided in a writing instrument, additional ink is supplied from the internal reservoir into the peripheral passages. The ink in the internal reservoir is also supplied from the external tank. This concept was conceived in the hope that the additional ink supply would improve the smooth ink flowing performance and increase the ink supplying ability, in comparison with that of the conventional non-coaxial passage case with substantially the same peripheral passage openings at the same nib head, and the present invention has been completed as a result of confirmation that the expected improvement is attained.

According to the present invention, a pen nib of a writing instrument is provided, which nib has a longitudinal form having a round or sharped head, and comprises a coaxial capillary passage for ink formed therein to extend axially and open at the head. The nib of the present invention, however, is characterized in that, in a cross-sectional view, the coaxial capillary passage has: a central and inner portion; a group of peripheral and outer portions radially spaced from the central inner portion; and intermediate connecting portions between the central portion and respective outer portions. The central passage portion and the intermediate passage portions all extend axially, but are axially closed at the head. The outer passage portions correspond to the conventional peripheral passages, and extend axially and open axially at the nib head. The axial openings or outlets formed in the head are arranged at a top surface of the head around a central area thereof, as in the conventional non-coaxial opening case.

The round or shaped head of the nib has a covering portion axially closing all the central and intermediate passage portions. The covering head portion has an axial length or thickness considerably short relative to the entire axial length of the nib, to thereby allow the central and intermediate connecting passage portions, in combination, to provide or relatively large ink reservoir formed in the nib for supplying the ink to the outer passage portions. The ink reservoir has a bottom positioned in the vicinity of the top head surface. The ink reservoir reserves the ink therein due to a capillary action, but can supply the ink into the outer passage portions through respective intermediate connecting passage portions forming local portions of the reservoir.

The reservoir may be called "an axial extension of the body tank" formed in the writing instrument.

The writing instrument has a body with the nib detachably connected thereto. The body has the above mentioned ink tank communicating with the coaxial passage of the nib, so that the ink is supplied into the nib reservoir and the outer passage portions having the peripheral axial openings or outlets at the nib head. Therefore, the ink can be supplied onto a paper during writing though the peripheral axial openings from not only the body tank but also from the nib reservoir.

In comparison with a conventional non-coaxial opening nib having the same peripheral openings at the nib head and peripheral capillary passages, all extending axially from the peripheral openings to the other end of the nib connecting to the body, the non-coaxial opening nib of the present invention is improved in that it ensures a smooth ink supply at a desired flow rate through the peripheral openings. With the comparative conventional nib, the ink supply is obliged to rely on only the peripheral passages, and thus the ink supply ability is inferior to that of the nib according to the present invention. To increase this ability to the same level as that of the present invention, additional peripheral passages and additional peripheral outlets communicating axially thereto are required, and an increase in the number of the peripheral openings is not easy to attain in the limited area of the top head surface, while maintaining a predetermined width of written line by the nib on the paper.

According to the present invention, the nib can ensure a smooth ink supply while maintaining a predetermined width of written line, and ensures a smooth writing without scratching a paper, because a central area of the top head surface has no openings at all. Further, a writing resistance or scratchiness is reduced accordingly. Still further, an amount of dust produced from the paper by the nib head is considerably reduced during a high speed writing, with the result interruptions of the smooth supply of ink by the dust are considerably reduced. In this regard, the present invention is most preferable for use in a high speed writing with a wear nib made of a hard material such as metal, ceramic or hard resin.

The present invention is suitable for providing such a wear nib, for the following reasons:

1. The quality of a sintered nib made of a wear material such as metal or ceramics depends on a sintering of a nib blank. In this regard, an injection molding of the blank is critically preferable in mass production, and an extruding method is not preferable, since it does not act to press-mold the blank. With both methods, a paste of a powder metal or ceramics with paste materials is used as a starting material.

2. The internal passage configuration of a nib according to the present invention, as a matter of course, does not allow the use of the extruding method, although that of a conventional nib does allow this. This is because the nib of the present invention has an axial passage for ink, which is designed to partially open axially at the nib head, such that only radial portions of the axial passage open axially at the head with a central portion being axially closed at the head, whereas the conventional nib has only axial passage for ink, which are all designed to be completely or straight forwardly open axially at the nib head.

According to the present invention, at least some of the above mentioned intermediate connecting portions of the coaxial ink passage may open radially at the nib head, particularly at the axial openings of corresponding outer passage portions, respectively. This is embodied such that the covering head portion at the subject intermediate portions is spaced axially from corresponding axial openings at the utmost radially outer edge point thereof, whereby the subject intermediate portions are allowed to open radially at the corresponding axial openings, respectively. Such an embodiment is viable because the nib head is round or sharpened with the result that any peripheral axial openings around a central area of the head top surface have the utmost radially inner edge point and the utmost radially outer edge point that are axially spaced from each other.

Such radially opening intermediate portions of the coaxial ink passage increase the ink supply onto the paper through the axial openings of the outer passage portions, in comparison with a case where such radially opening intermediate portions do not exist. The radial openings as described above may be attained by designing the axial thickness of the covering head portion to an appropriate level, the axial opening of the outer passage portion to an appropriate profile and/or the nib head to an appropriate shape.

Preferably, each axial opening at the nib head is chamfered to give a round edge at the top head surface, to thereby reduce a writing resistance produced by the axial opening and to allow the dust to be discharged smoothly out of the opening with the ink, where the dust produced form the paper is forced to enter the opening.

The axial opening may have a stepped portion following its edge. The stepped opening portion forms a groove for smoothly guiding and discharging the dust.

The pen nib of the present invention may, of course, have peripheral passages axially extending and axially open at the head corresponding to those of a conventional nib, in addition to the coaxial ink passage partially opening axially at the head.

BRIEF DESCRIPTION OF THE DRAWINGS

FIG. 1 shows a first embodiment of a pen nib according to the present invention, wherein

FIG. 2 shows a second embodied nib of the present invention, wherein

FIG. 3 shows a third embodied nib of the present invention wherein

FIG. 4 shows a fourth embodied nib of the present invention, wherein

FIG. 5 shows a fifth embodied nib of the present invention, wherein

FIG. 6 shows a sixth embodied nib of the present invention, wherein

FIG. 7 shows a seventh embodied nib of the present invention, wherein

FIG. 8 shows an eighth embodied nib of the present invention, wherein

FIG. 9 shows a ninth embodied nib of the present invention, wherein

FIG. 10 shows a tenth embodiment of the present invention, wherein

FIG. 11 shows an eleventh embodied nib of the present invention, wherein

FIG. 12 shows a twelfth embodied nib of the present invention, wherein

FIG. 13 shows a thirteenth embodied nib of the present invention, wherein

FIG. 14 shows a fourteenth embodied nib of the present invention, wherein

FIG. 15 shows a fifteenth embodied nib of the present invention, wherein

FIG. 16 shows a sixteenth embodied nib of the present invention, wherein

DESCRIPTION OF THE PREFERRED EMBODIMENTS

Figure 1A:
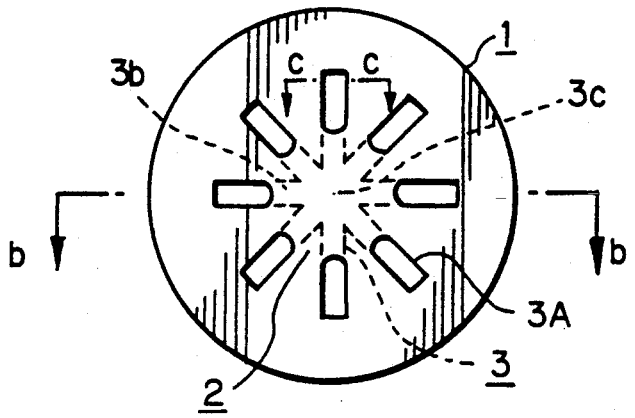
FIG. 1A is a front view of the nib, seen from the head thereof.

Various embodied pen nibs of a writing instrument according to the present invention will be now described with reference to FIGS. 1 to 17. All of the embodied nibs are wear nibs and made of powder metal or ceramics by injection molding, with a subsequent sintering process. These nibs also may be made of a hard resin such as a thermosetting resin by a method similar to the above.

In the drawings, the same numbers or symbols denote the same or similar elements or members of the embodied wear nibs.

Figure 1B:
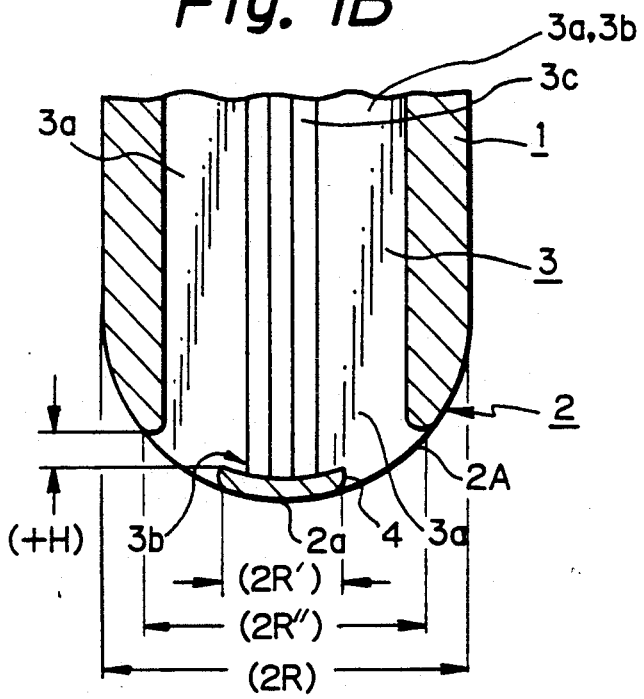
FIG. 1B is an axially sectional view of the nib taken along the line b—b of FIG. 1A.
Figure 1C:
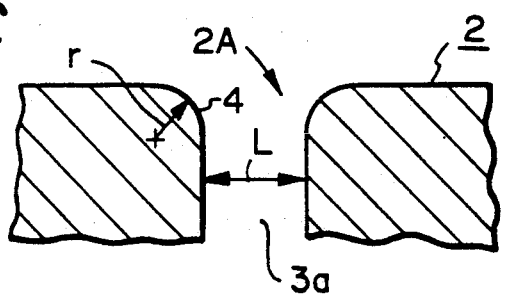
FIG. 1C is an enlarged sectional view of an opening at the nib head taken along the line c—c of FIG. 1A.

Referring to FIG. 1, a first embodied wear nib 1 is of a longitudinal solid form having an axial length of 8.8 mm and a diameter (2R) of 1.0 mm. The wear nib 1 has a coaxially extending ink passage 3 formed therein, which partially open axially at a head 2 of the nib. The head 2 is formed to be round. The coaxial passage 3 has, in a cross-sectional view, a coaxial portion 3*c*, equiangularly spaced intermediate connecting portions 3*b* and equiangularly spaced outer peripheral portions 3*a*. The coaxial portion 3*c* communicates with the outer peripheral portions 3*a* through corresponding intermediate connecting portions 3*b*. The coaxial portion 3*c* and the intermediate connecting portions 3*b* are all closed axially at the head 2, whereas each outer peripheral portion 3*a* completely opens axially whereby peripheral axial openings or outlets 2A for ink are formed at the head 2 around a central area of the head top surface as shown in FIG. 1A and FIG. 1B.

The peripheral openings 2A have a radially extending form, and are chamfered to form a round edge 4 having a curvature radius r of 0.03 mm. The central passage portion 3*c* and the intermediate connecting passage portions 3*b* are all covered by a central portion 2*a* of the head 2, which axial thickness is 0.05 mm. The width L of the opening 2A or outer passage portion 3*a* is 0.04 mm. The intermediate connecting passage portions 3*b* have the same profile and a radially extending form.

According to the present invention, the nib with the above coaxial ink passage 3 having the peripheral outlets 2A is rotation symmetrical. The covering head portion 2*a* has a central local surface area of a coaxial circle inscribing peripheral openings located the shortest radial distance form the nib axis or center. Preferably, the inscribed circle has a radius R' of 0.025 mm to 0.8 R", where R" is a radius of a circle circumscribing at least some of the peripheral openings, of which the utmost radially outer edges are radially spaced at the longest distance from the center of the head.

With the nib of FIG. 1, the radius R' of the inscribed circle is 0.06 mm, and a radius R of the nib is 0.5 mm.

The larger the radius of the inscribed circle, the lower the writing resistance with the amount of the produced dust being reduced, whereas the smaller the effective surface area of the nib head 2 around the inscribed circle, where the peripheral openings 2A are allotted, the greater the reduction of the ink flow ability of the nib.

In this regard, the radius of the inscribed circle is a critical factor when designing a pattern of the coaxial ink passage having only peripheral openings at the nib head.

As shown in FIG. 1B, there is a positive axial gap H between the covering head portion 2*a* at each intermediate connecting passage portion 3*b* and the utmost radially outer edge point of a corresponding peripheral opening 2A. This axial gap H allows the intermediate passage portions 3*b* to open radially at the axial peripheral axial openings 2A, so that the ink in the intermediate connecting passage portions 3*b* can flow out of the openings of the outer passage portions 3A at the head directly, and is allowed to flow into the adjacent outer passage portions 2A over the entire axial length.

The nib of the present invention is provided therein with an ink reservoir formed by the central portion 3*c* and the intermediate connecting portions 3*b* of the coaxial passage 3. The ink is supplied directly from a tank provided in the writing instrument to the peripheral outer passage portions 3*a* and to the internal reservoir (3*b*, 3*c*), and the ink in the peripheral outer passage portions 3*a* is supplied onto a paper, during writing, through the peripheral axial openings 2A, while the ink in internal reservoir (3*b*, 3*c*) can be fed radially to the peripheral outer passage portions 3*a* over the entire axial length.

With the first embodiment of the nib having the above mentioned axial gap H, the ink in the internal reservoir (3*b*, 3*c*) can be supplied radially to the peripheral openings 2A directly without passing through the peripheral outer passage portions 3*a* at the nib head 2.

The nib allows a smooth writing with the instrument at any position between the vertical position and an inclined position of 50° from the vertical position.

Since the peripheral openings 2A have the chamfered round edges, the dust produced from a paper can be easily removed from the openings 2A.

Since the nib has the covering top head portion 2*a*, which is smoothly round, the paper is considerably less damaged with less produced dust even in a high speed writing, in comparison with a conventional nib having a central opening. Further, ink flowing through the peripheral openings 2A is superior to that of a conventional nib having no coaxial opening but having the same peripheral openings. The writing resistance is considerably reduced, compared with the above non-coaxial opening nib.

Further, it is advantageous in that the drain back phenomenon does not occur, and thus an ink scratching of the pen does not occur at the beginning of writing. The wear pen nib 1 is thus advantageous for use onto either a soft paper or a hard paper or the like, and for use in either a hand writing or a high speed writing by a plotter.

Figure 2A:
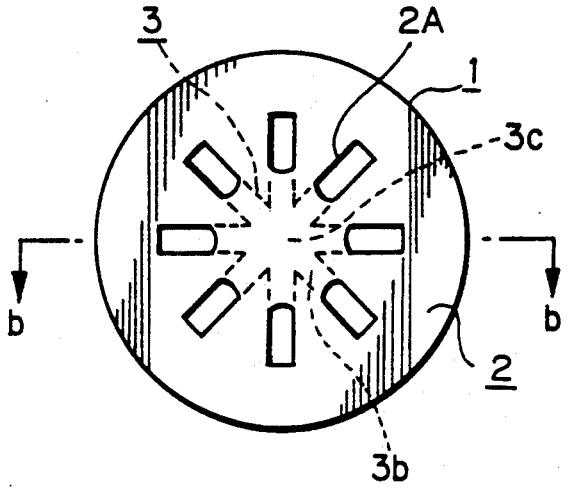
FIG. 2A is a front view of the nib.
Figure 2B:
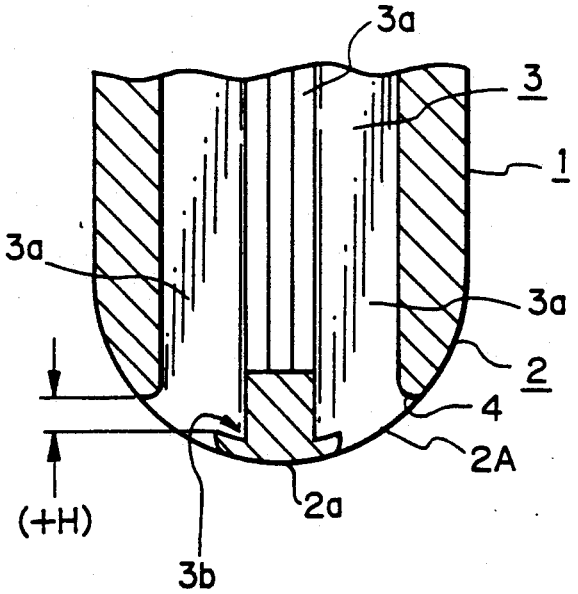
FIG. 2B is an axially sectional view of the nib taken along the line b—b of FIG. 2A.

Referring to FIG. 2, a second embodied wear nib 1 is substantially the same as or similar to that of FIG. 1 except that a corresponding covering head portion 2*a* is made thicker at a corresponding central passage portion 3*c* to thereby project locally inward at a central area of the rear face. The thickness of the locally projected covering head portion is 0.26 mm. A round edge of each corresponding peripheral opening 3*a* has a curvature radius of 0.09 mm.

Due to the increased thickness of the covering head portion, the second embodied wear nib has an increased resistance against impact generated by the paper when the nib is forced to touch the paper frequently with a relatively strong force for writing, and thus it is more preferable for use in a plotter in this respect.

Figure 3A:
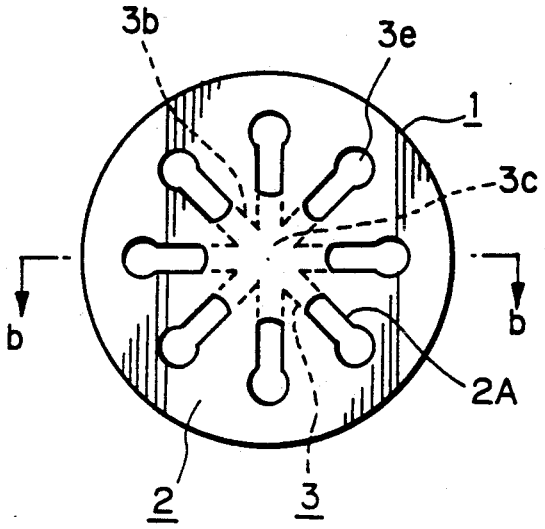
FIG. 3A is an axially sectional view of the nib.
Figure 3B:
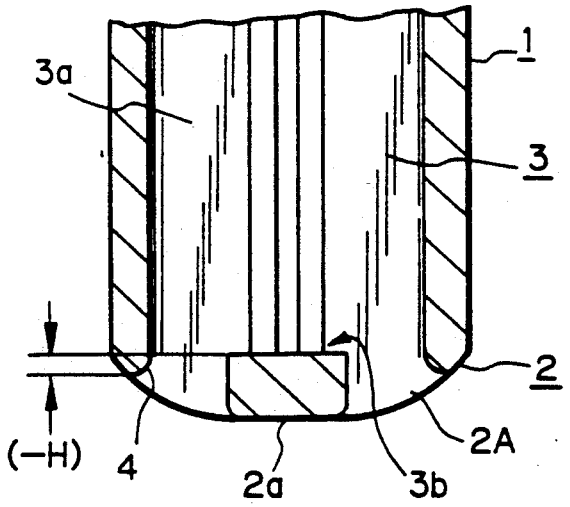
FIG. 3B is an axially sectional view taken along the line b—b of FIG. 3A.

Referring to FIG. 3, a third embodied wear nib 1 is substantially the same as or similar to that of FIG. 1 except for a corresponding head 2 having a flattened top local face, a corresponding covering head portion being thicker (0.17 mm thickness) over the entire rear face thereof, and each corresponding outer passage portion 3*a* having an enlarged semi-circle local portion 3*e*, so that the ink supply ability of a corresponding peripheral opening 3*a* is increased.

Nevertheless, in turn, a corresponding axial gap H is a negative value, so that the thick covering head portion 2 prevents each corresponding intermediate passage portion 3*b* from opening radially at a corresponding enlarged opening 2A. In this regard, even if the ink supply ability of the nib is substantially the same as that of FIG. 1, the nib of FIG. 3 has an increased resistance against the impact compared to that of FIG. 2. A round edge of each enlarged opening 2A has a curvature radius of 0.2 mm.

Figure 4A:
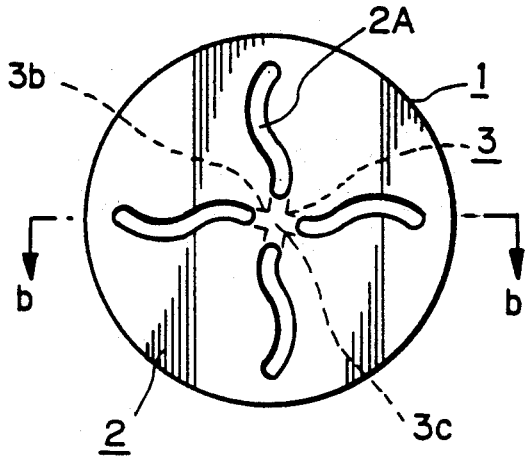
FIG. 4A is a front view of the nib.
Figure 4B:
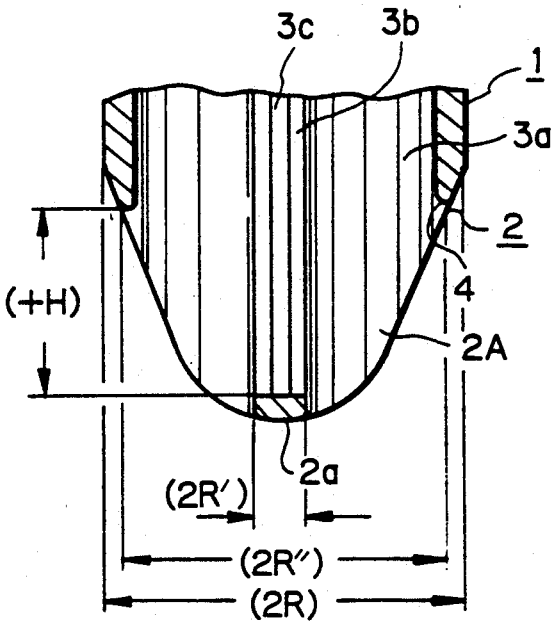
FIG. 4B is an axially sectional view of the nib taken along the line b—b of FIG. 4A.

Referring to FIG. 4, a fourth embodied wear nib is substantially the same as or similar to that of FIG. 1 except for each corresponding outer passage portion 3*a* and opening 2A having a waved or S-shaped profile. The waved openings may have corresponding utmost radially outer and inner edge points arranged along the same circles as those of FIG. 1. In this connection, the nib such as shown in FIG. 4 can have the waved openings enlarged in the entire area, relative to the straight openings of FIG. 1, while the number of the openings is the same, but the width of the written line on the paper is the same. As a result, the ink supply ability of the nib is increased compared with that of FIG. 1.

Further, the nib such as shown in FIG. 4 can have the same entire area of the openings as that of FIG. 1, but the number of the openings of FIG. 4 is reduced. In this case, the writing resistance of the nib is reduced, and a possible amount of the dust from the paper is reduced.

Further, the S-shaped opening is advantageous in that it is not easy for the dust to clog the opening, since the opening orients in various directions rather than a single direction such as that of FIG. 1.

The thickness of a corresponding covering head portion 2*a* of FIG. 4 is 0.08 mm, and a corresponding inscribed circle has a radius R' of 0.025 mm, and a radius R of the nib is 0.4 mm.

Figure 5A:
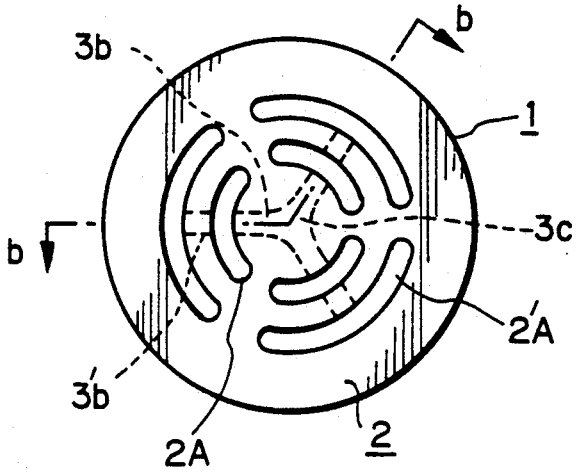
FIG. 5A is a front view of the nib.
Figure 5B:
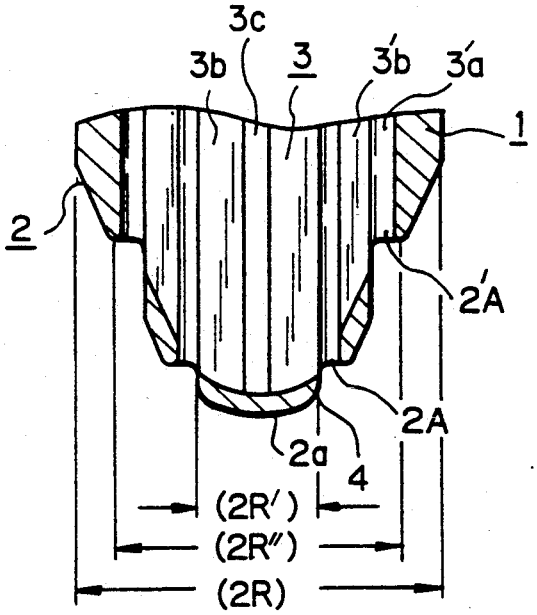
FIG. 5B is an axially sectional view taken along the line b—b of FIG. 5A.
Figure 6A:
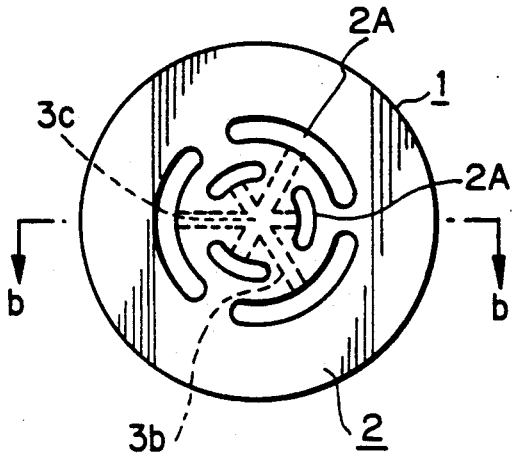
FIG. 6A is a front view of the nib.
Figure 6B:
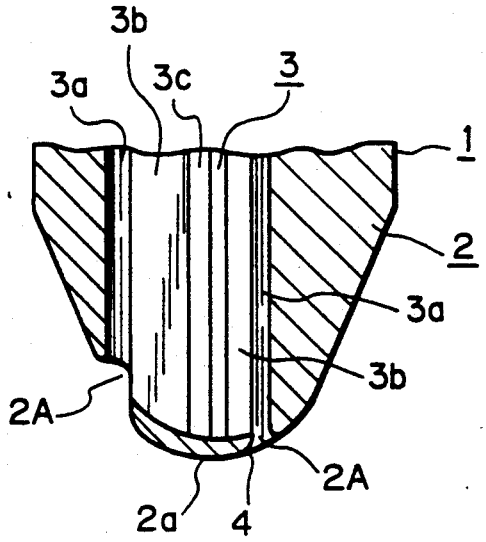
FIG. 6B is an axially sectional view of the nib taken along the line b—b of FIG. 6A.
Figure 7A:
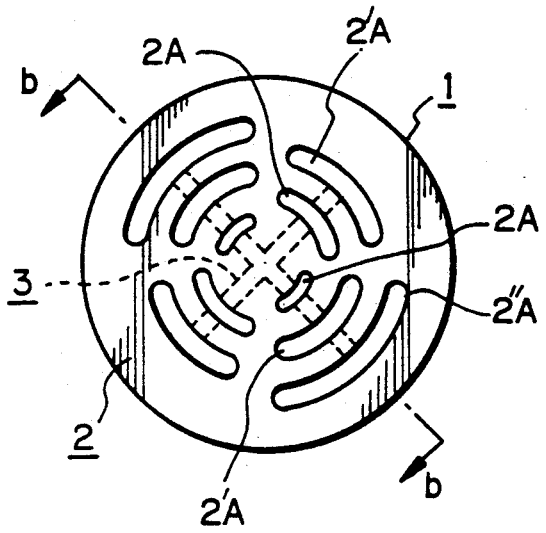
FIG. 7A is a front view of the nib.
Figure 7B:
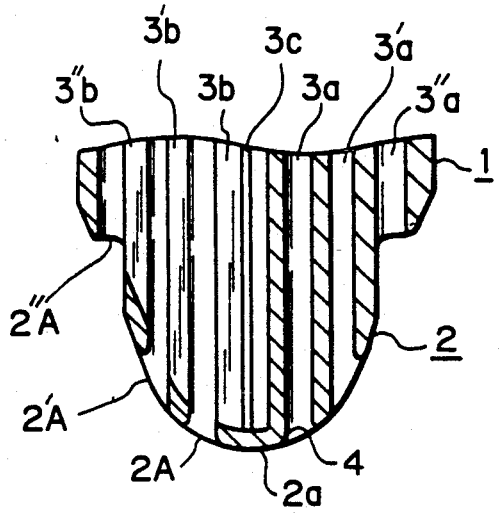
FIG. 7B is an axially sectional view of the nib taken along the line b—b of FIG. 7A.

Referring to FIG. 5, a fifth embodied wear nib is substantially the same as or similar to that of FIG. 1 except for a second group of outer passage portions 3'a being additionally formed radially outside of corresponding outer passage portions 3a with additional intermediate connecting passage portions 3'b provided between the first and second groups of outer passage portions 3a and 3'a. The additional intermediate connecting passage portions 3'b are all axially closed at the head 2, similar to corresponding intermediate passage portions 3b.

Each pair of the intermediate passage portions 3b and 3b' extends in the same radial direction, and each pair of the outer passage portions 3a and 3'a is located in the same radial direction. Each group of outer passage portions 3a or 3'a is equiangularly spaced around the center of the head, and open at respective peripheral openings 2A or 2'A.

A corresponding covering head portion 2, also covering the additional intermediate connecting passage portions 3'b, has an axial thickness of 0.03 mm. A corresponding inscribed circle has a radius R' of 0.1 mm, and a radius R of the nib is 0.6 mm.

Sixth, Seventh, eighth and ninth embodied wear nibs as shown in FIGS. 6, 7, 8 and 9 are various modifications of the fifth embodied nib of FIG. 5, regarding the pattern of the coaxial passage with the peripheral openings.

The nibs of FIGS. 6, 7, 8 and 9 have a further improved capacity for supplying the ink onto the paper from the openings in various directions other than that of FIG. 5.

Figure 8A:
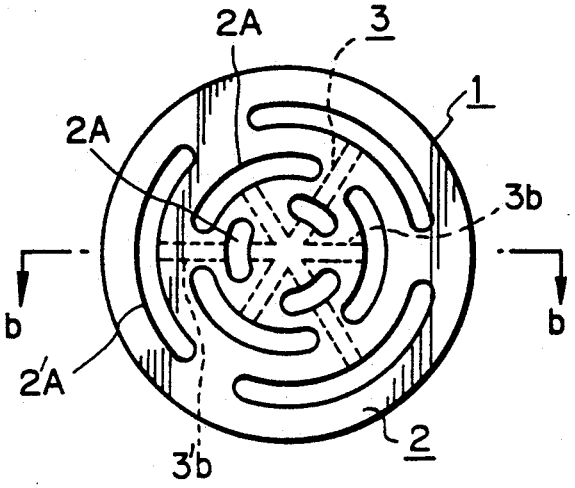
FIG. 8A is a front view of the nib.
Figure 8B:
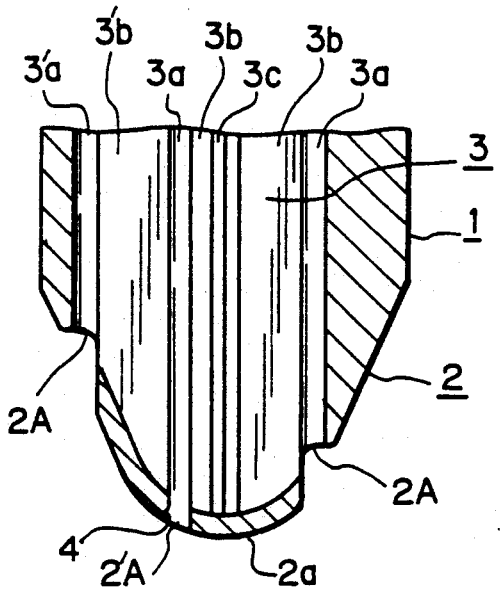
FIG. 8B is an axially sectional view of the nib taken along the line b—b of FIG. 8A.
Figure 9A:
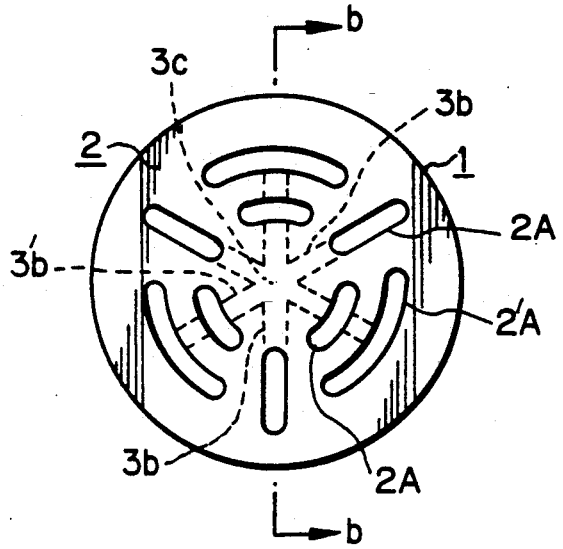
FIG. 9A is a front view of the nib.
Figure 9B:
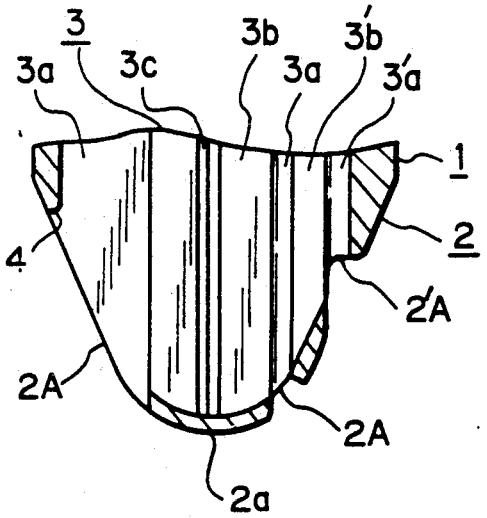
FIG. 9B is an axially sectional view of the nib taken along the line b—b of FIG. 9A.

With respect to the nib of FIG. 8, a third group of peripheral openings 3"A is spaced equiangularly along a circle in the vicinity of the periphery of the top head surface, and thus the writing stability with the nib inclined relative to the paper is improved, compared with that of the fifth embodied nib as shown in FIG. 5.

Figure 10A:
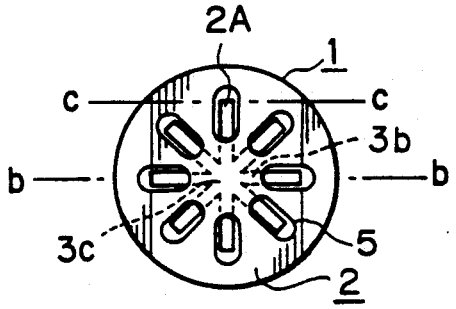
FIG. 10A is a front view of the nib.
Figure 10B:
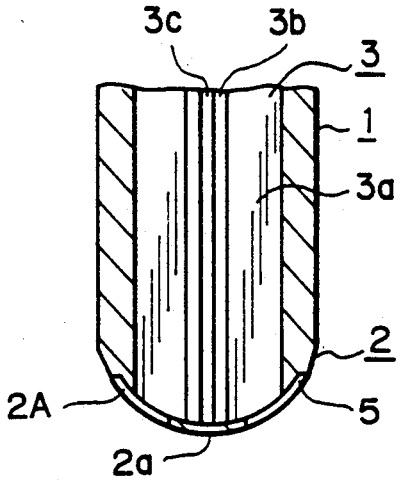
FIG. 10B is an axially sectional view of the nib taken along the line b—b of FIG. 10A.
Figure 10C:
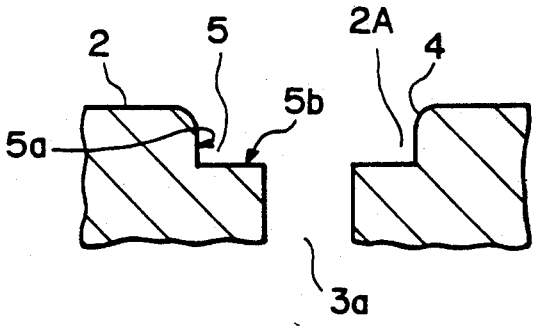
FIG. 10C is an enlarged sectional view of an opening at the nib head taken along the line c—c of FIG. 10A.

Referring to FIG. 10, a tenth embodied wear nib is substantially the same as or similar to that of FIG. 1 except that each corresponding peripheral axial opening 2A, has a stepped portion 5 following the edge thereof. The stepped opening portion 5 is an enlarged top portion of the axial openings 2A, and forms a groove for guiding and discharging the dust out of the opening, together with the ink. Since the nib head 2 is round or sharped as shown in FIG. 10, the groove 5 can have a local face extending in a direction semi-perpendicular to the nib axis or inclined toward the rear end of the nib in the radial direction at the utmost radially outer edge of the peripheral opening 2A, in an axially sectional view of the nib. In this connection, the dust is apt to be guided along the groove and discharged from the utmost radially outer edge. The stepped opening portion 5 has inner and outer local faces 5a, 5b, but preferably both the local faces, in combination, form a single flat face at the utmost radially outer edge of the opening 2A or 2B, i.e., preferably the opening may not be stepped at the utmost radially outer edge, in addition to the utmost radially inner edge.

Figure 11A:
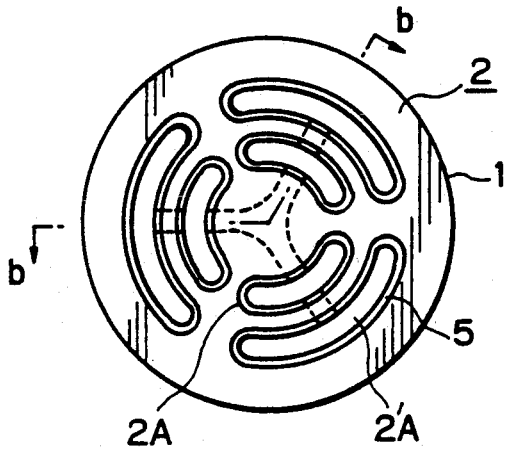
FIG. 11A is a front view of the nib.
Figure 11B:
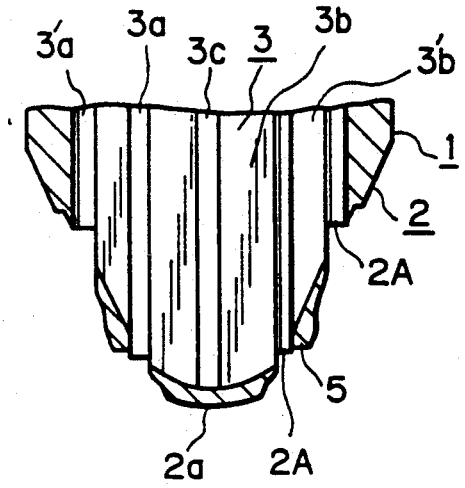
FIG. 11B is an axially sectional view of the nib taken along the line b—b of FIG. 11A.

Referring to FIG. 11, an eleventh embodied nib is substantially the same or similar to that of FIG. 5 except for each corresponding peripheral opening 3A having a groove 5 equivalent to that of FIG. 10.

Figure 12A:
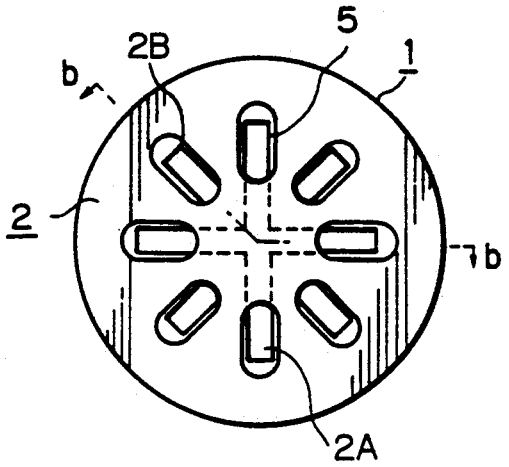
FIG. 12A is a front view of the nib.
Figure 12B:
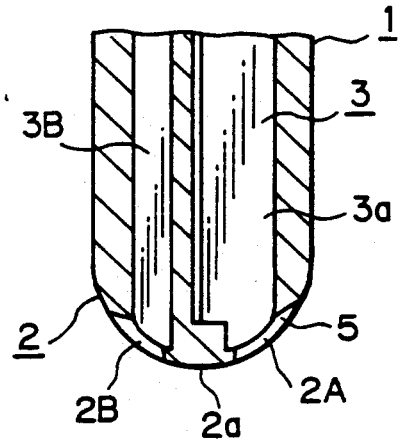
FIG. 12B is an axially sectional view of the nib taken along the line b—b of FIG. 12A.
Figure 13A:
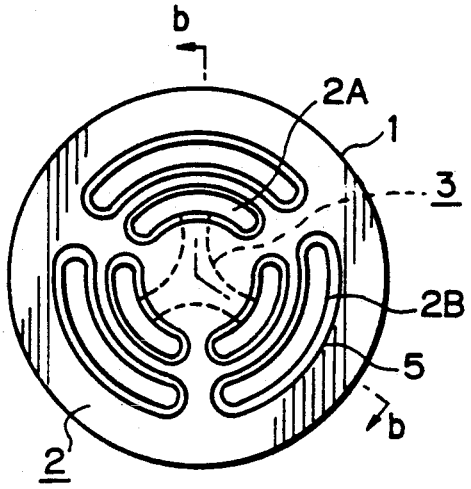
FIG. 13A is a front view of the nib.
Figure 13B:
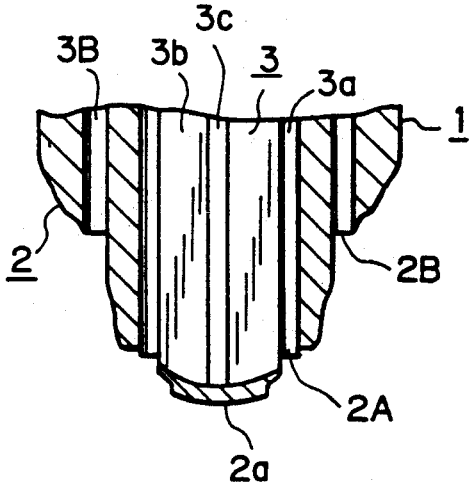
FIG. 13B is an axially sectional view of the nib taken along the line b—b of FIG. 13A.
Figure 14A:
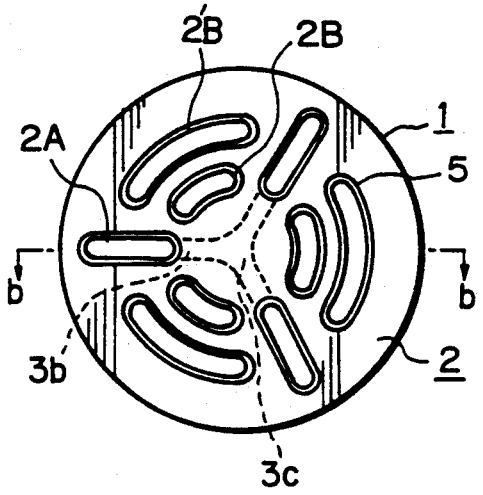
FIG. 14A is a front view of the nib.
Figure 14B:
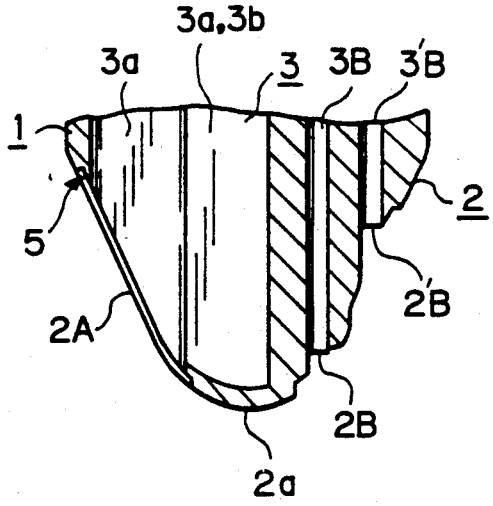
FIG. 14B is an axially sectional view taken along the line b—b of FIG. 14A.

Referring to FIG. 12, FIG. 13 and FIG. 14, embodied nibs are substantially the same or similar to that of FIG. 10 except for additional peripheral openings 2B being formed at the nib head, each with a corresponding groove 5, and additional axially extending passages 3B being formed in the nib to open axially at corresponding additional peripheral openings 2B. The additional peripheral openings 2B of FIGS. 12 and 14 are spaced equiangularly and are arranged alternately with the radially inner peripheral openings 2A of a corresponding coaxial passage 3a around the center of the nib head.

The pattern of the peripheral openings as shown in FIG. 13 is substantially the same as that of FIG. 5 except for the radially outer openings 2B of FIG. 13 being isolated from the others, whereas corresponding outer openings 2'A of FIG. 5 communicate with the inner openings 2A via the intermediate connecting passage portions 3b.

Figure 15A:
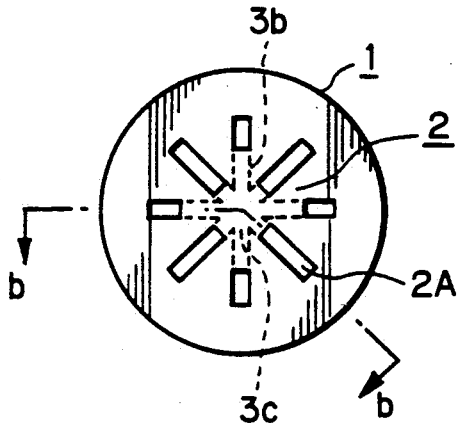
FIG. 15A is a front view of the nib.
Figure 15B:
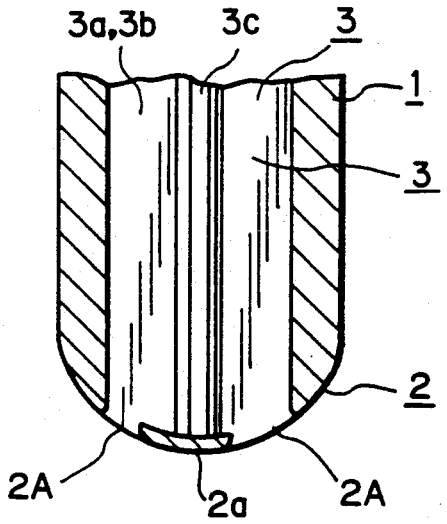
FIG. 15B is an axially sectional view of the nib taken along the line b—b of FIG. 15A.
Figure 16A:
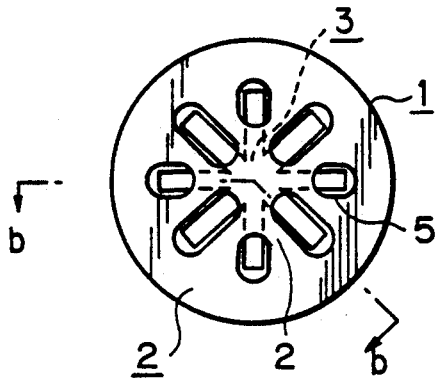
FIG. 16A is a front view of the nib.
Figure 16B:
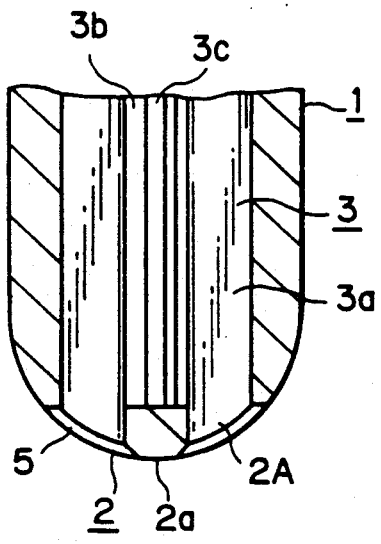
FIG. 16B is an axially sectional view of FIG. 16A.

Referring to FIG. 15 and FIG. 16, the embodied nibs are substantially the same or similar to those of FIG. 1 and FIG. 10, respectively, except for corresponding peripheral openings 3A consisting of radially longer openings and radially shorter openings, which are arranged alternately with each other around the center of the nib head 2.

With the nibs of FIGS. 15 and 16, all of the peripheral openings 2A circumscribe a larger circle, and the longer openings among them inscribe a smaller circle. With a corresponding central passage portion 3c having the same size and cross-sectional profile as those of FIGS. 1 and 10, respectively, the longer peripheral openings communicate with shorter ones, respectively, among corresponding intermediate connecting passage portions 3b.

In comparison with the nibs as shown in FIGS. 1 and 10 having the same head 2, the nibs as shown in FIGS. 15 and 16 can provide an enlarged portion 2a of the head 2 covering the central and intermediate passage portions (3c and 3b), assuming that the entire area of the peripheral openings 3A is the same. The enlarged covering head portion 2a decreases an amount of dust produced from a paper during a high speed writing, and decreases a writing resistance, while maintaining the same ink supply ability. A corresponding inscribed circle of FIG. 15 has a radius of 0.06 mm, and a radius of the nib is 0.45 mm.

Figure 17:
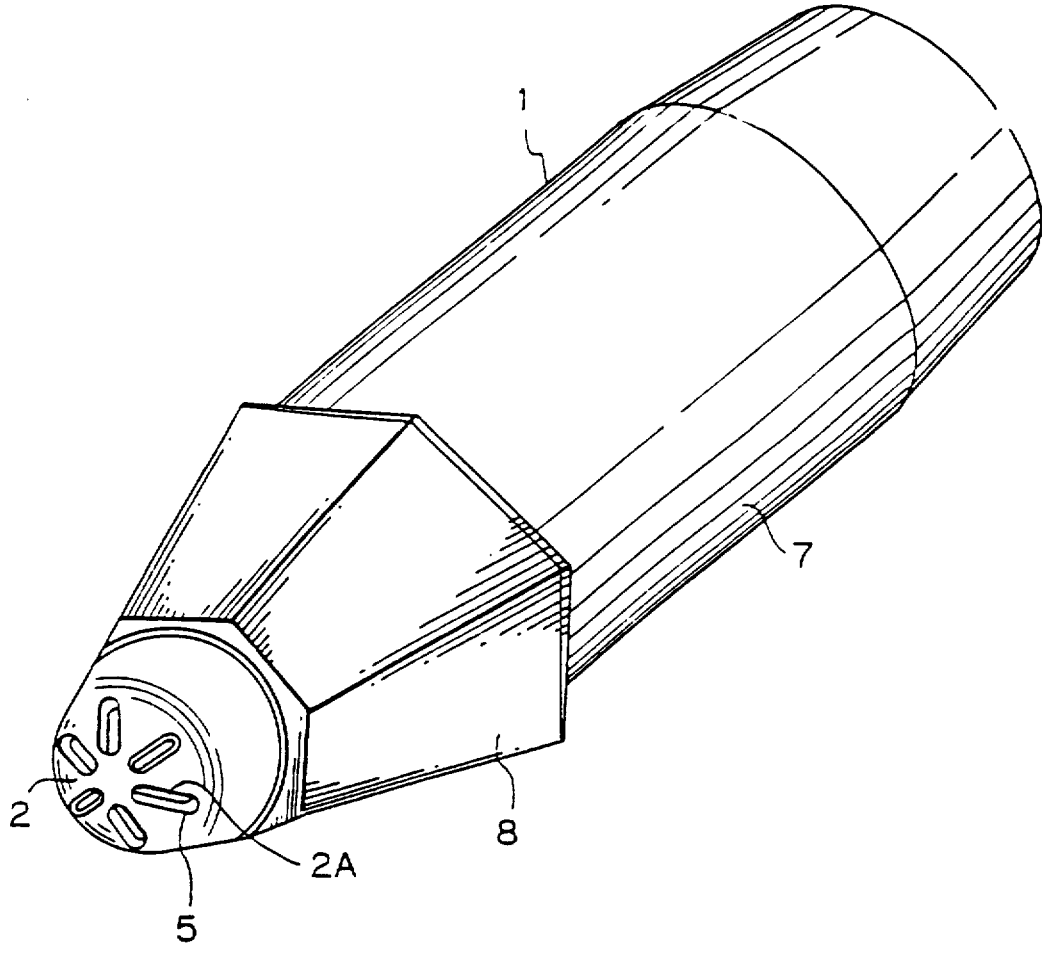
FIG. 17 is a perspective view showing the entire profile of a seventeenth embodied nib of the present invention.

All of the embodiments as shown in FIGS. 1 to 16 show wear nibs of a cylindrical axial extension, having a round head 2, whereas FIG. 17 shows a wear nib 1 consisting of a cylindrical axial extension portion 7, polygonal tapered portion 8 and a round head 2 having peripheral openings 2A similar to those of FIG. 10. The cylindrical portion 7 is disposed into the body of the writing instrument and the polygonal tapered portion 8 acts as a stopper against the body.

According to the present invention, the wear nib is produced, using an injection molding, with a subsequent heat treatment such as a sintering process. In this connection, it is easy to provide a wear nib having a relatively complicated profile such as that of FIG. 17, as needed, by the above method, whereas the extruding method cannot produce such a complicated profiled nib, although it also, of course, cannot produce a nib having a coaxial ink passage formed in the nib body, which partially opens axially at peripheral openings formed in the nib head around the center thereof.

We claim:

1. A pen nib of a writing instrument, of a longitudinal form having a round or sharped head, the nib comprising a coaxial capillary passage for ink formed therein to extend axially and open at the head, characterized in that the coaxial capillary passage has: a central and inner portion; a group of peripheral and outer portions radially spaced from the central portion; and intermediate connecting portions between the central portion and respective outer portions in a cross-sectional view, the central passage portion and the intermediate connecting passage portions extending axially but being axially closed at the head, and the outer passage portions extending axially and being open axially at peripheral openings or outlets formed in the head such that they are arranged at a top surface of the head around the center thereof.

2. A pen nib according to claim 1, wherein the round or sharped head has a covering portion axially closing the central and intermediate connecting passage portions, the covering head portion having a considerably short axial length or thickness relative to the entire axial length of the nib, to thereby allow the central and intermediate connecting passage portions, in combination, to provide a relatively large ink reservoir formed in the nib for supplying the ink to the outer passage portions, the ink reservoir having a bottom positioned in the vicinity of the top head surface.

3. A pen nib according to claim 2, wherein, in the covering head portion, at least some of the intermediate passage portions are spaced axially from corresponding axial openings at the utmost radially outer edge points thereof, whereby the corresponding intermediate passage portions are open radially at the corresponding axial openings, respectively.

4. A pen nib according to claim 2, wherein the covering head portion is axially thick enough to radially close the intermediate passage portions at corresponding axial openings.

5. A pen nib according to claim 2, further comprising a plurality of capillary passages spaced radially from the nib axis, each extending axially and opening axially at the head.

6. A pen nib according to claim 3, wherein some of the spaced peripheral openings are arranged at the utmost radially inner edges thereof along a first coaxial circle, and the others are arranged at the utmost radially inner edges thereof along a second coaxial circle larger than the first one, in an axially front view.

7. A pen nib according to claim 4, wherein some of the spaced outer passage portions are arranged at the utmost radially inner edges thereof along a first coaxial circle and the others are arranged at the utmost radially inner edges thereof along a second coaxial circle larger than the first one, in the cross-sectional view.

8. A pen nib according to claim 1, wherein the coaxial capillary passage has a second group of spaced peripheral and outer portions, and second intermediate connecting portions between the second outer portions and at least some of the first outer portions in the cross-sectional view, the second intermediate connecting passage portions extending axially but being axially closed at the head, and the second outer passage portions being extended axially and opening axially at additional spaced peripheral openings formed in the head.

9. A pen nib according to any one of claims 1 to 8, wherein each peripheral opening is chamfered to have a round peripheral edge at the head surface.

10. A pen nib according to claim 9, wherein each peripheral opening has a stepped portion following the round peripheral edge thereof, to form a groove inside thereof for guiding and discharging dust from the utmost radially outer edge thereof.

11. A pen nib according to claim 10, wherein each stepped portion has inner and outer local faces, both the local faces forming, in combination, a single flat face at the utmost radially outer edge of a corresponding opening so that the dust can be easily discharged out of the opening through the flat face.

12. A pen nib according to claim 9, wherein the nib is made of hard material such as hard plastics, metals or ceramics, by injection molding with a subsequent heat treatment.

13. A pen nib according to claim 12, wherein the covering head portion has a central local surface area within a coaxial circle inscribing at least some of the peripheral openings, of which the utmost radially inner edges are radially spaced at the shortest distance from the center of the head, said inscribed circle having a radius of 0.025 mm to 0.8 R", where R" is a radius of another circle circumscribing at least some of the peripheral openings, of which the utmost radially outer edges are radially spaced at the longest distance from the head center.

14. A pen nib according to claim 13, wherein the axial thickness of the covering head portion is 0.02 to 0.30 mm.

* * * * *

UNITED STATES PATENT AND TRADEMARK OFFICE

CERTIFICATE OF CORRECTION

PATENT NO. : 5,238,320

DATED : August 24, 1993

INVENTOR(S) : Takahiro Komatsu, et al

It is certified that error appears in the above-indentified patent and that said Letters Patent is hereby corrected as shown below:

The sheet of drawing consisting of Figure 17 should be added as per attached sheet.

Signed and Sealed this

Third Day of May, 1994

Bruce Lehman

*Attest:*

BRUCE LEHMAN

*Attesting Officer*

*Commissioner of Patents and Trademarks*